US005240257A

United States Patent [19]

Sassak

[11] Patent Number: 5,240,257

[45] Date of Patent: Aug. 31, 1993

[54] AERIAL THROWING GAME

[76] Inventor: Mark S. Sassak, 1340 Linden, Plymouth, Mich. 48170

[21] Appl. No.: 827,404

[22] Filed: Jan. 29, 1992

[51] Int. Cl.[5] ..... A63B 63/00; A63B 67/18; F41J 3/00

[52] U.S. Cl. ..... 273/344; 273/67 B; 273/346

[58] Field of Search ..... 273/344, 346, 412, 417, 273/67 R, 67 B

[56] References Cited

U.S. PATENT DOCUMENTS

| | | | |
|---|---|---|---|
| 429,953 | 6/1890 | Pratt | 273/344 |
| 3,954,266 | 5/1976 | Carrano et al. | 273/412 X |
| 4,017,076 | 4/1977 | Bai | 273/346 |
| 4,832,348 | 5/1989 | Exel | 273/344 |
| 4,995,617 | 2/1991 | Lee | 273/346 |
| 5,066,017 | 11/1991 | Kurland | 273/344 |
| 5,085,442 | 2/1992 | Lee | 273/346 |
| 5,165,684 | 11/1992 | Pratt | 273/67 B |

*Primary Examiner*—William H. Grieb
*Attorney, Agent, or Firm*—Harness, Dickey & Pierce

[57] ABSTRACT

An aerial throwing game having at least one projectile and a two-piece selectively detachable target structure is provided. The projectile preferably has shuttle-cock like body with a suction cup extending from the leading end. The target structure includes a concave backing member and a detachable plate member having a relatively flat, smooth outer surface for receiving the projectile. An air gap is provided between the plate member and the backing member which provides a rebounding effect which facilitates adherence of the suction cup on the plates' outer surface.

17 Claims, 1 Drawing Sheet

AERIAL THROWING GAME

BACKGROUND OF THE INVENTION

1. Technical Field

This invention relates to a throwing game and, more particularly, to an apparatus which allows the participants the opportunity to play a variety of aerial throwing games. A projectile such as a shuttle-cock having a suction cup on a leading end is directed at the apparatus which comprises a plate member and a backing member, wherein the backing member is provided with a strap for handling the target structure.

2. Discussion

A number of different types of throwing games utilizing darts or shuttle cocks which include suction cups which are directed at a target structure are known in the art. One such throwing game is disclosed in U.S. Pat. No. 4,832,348 by Exel, which discloses a catch plate having a chambered front side and a holding loop on the rear side. The shuttle cock-like throwing body includes a suction cup for adherence wherein the throwing body is directed at the catch plate. Traditionally, the target structures of the known aerial dart or shuttle-cock throwing games tend to offer reduced adherence by the aerial dart or shuttle cock to the catch plate. Additionally, the target structures of the previously known aerial dart or shuttle-cock games are generally incapable of being adapted to a variety of games.

It is accordingly the primary object of the present invention to provide an aerial throwing game in which the target structure has improved adhesion characteristics to facilitate adhesion by the dart or shuttle cock throwing member.

It is another object of the present invention to provide an aerial throwing game apparatus which is adaptable for playing a variety of different games.

Additional objects and advantages of the present invention will become apparent from a reading of the detailed description of the preferred embodiments which made reference to the following sets of drawings.

DETAILED DESCRIPTION OF THE PREFERRED EMBODIMENT

Figure 1:
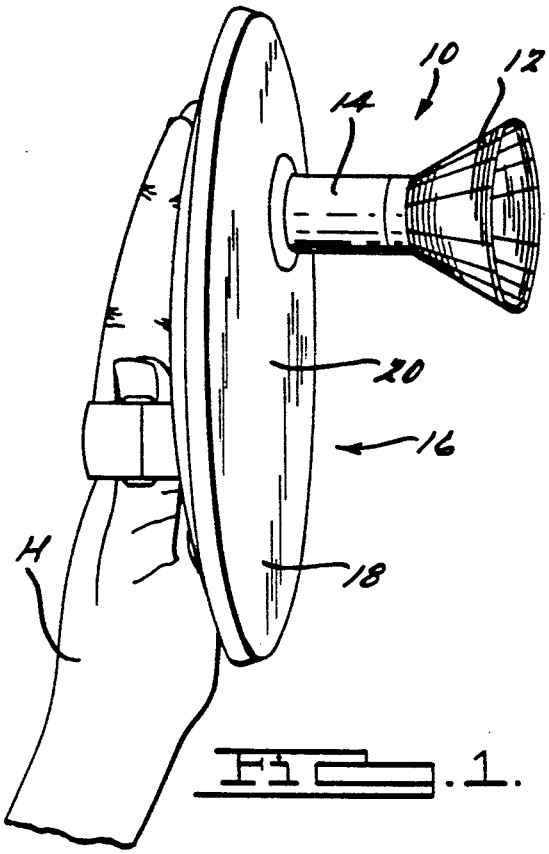
FIG. 1 is a perspective view of the present invention showing the throwing member directed upon the target structure.

Referring now to the drawings, FIG. 1 is a perspective view according to the present invention showing a target structure 16 secured to the hand "H" of a player and a projectile 10 engaging the target structure 16. The game of the present invention is intended to be played by two or more people by directing the projectile 10 in the direction of the target structure 16. The target structure 16 is manipulated by the player into a position intercepting the line of flight of the projectile, thrown by another player, whereby to receive and temporarily hold the projectile.

Figure 3:
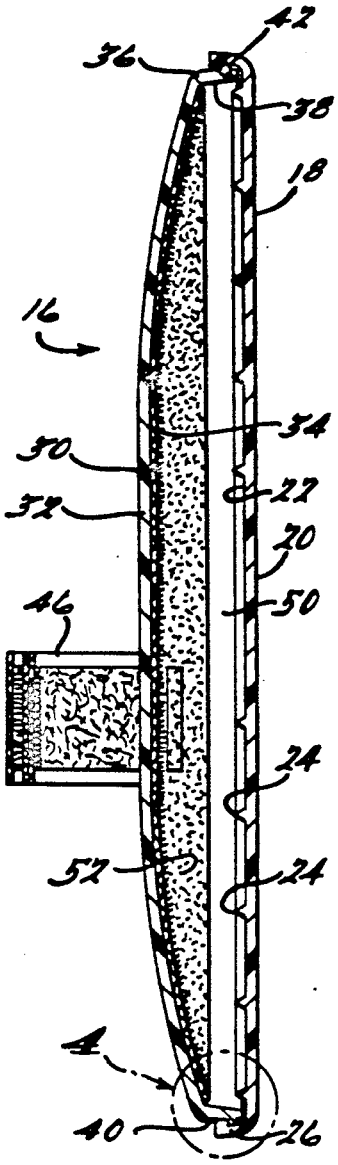
FIG. 3 is a cross-sectional side view of the present invention taken along lines 3—3 of FIG. 2.
Figure 4:
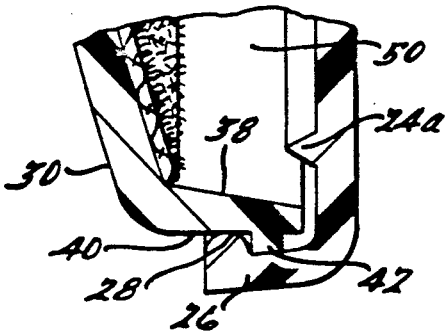
FIG. 4 is an enlarged fragmentary showing the connection between the components which form the target structure of the present invention.

Referring to FIGS. 3 and 4, cross-sectional views showing the target structure 16 in an assembled position are provided. The backing member 30, which has an overall concave shape, includes an outer surface 32 and an inner surface 34. Projecting upwardly along the periphery of the inner surface 34 is a lip 36 which has an inner wall 38 and an outer wall 40. The outer wall 40 is further provided with an outwardly projecting annular surface 42. Slots 44 are provided on the backing member 30 to provide points of attachment for a strap 46 which allows the player to rotate the backing member 30 to a desired position. The inner surface 34 can be lined with a variety of target surfaces. For example, one such surface 52 is a Velcro® hook pad which can be adhered to the inner surface so that a projectile having Velcro® padding can be directed and adhered to the hook pad.

The plate member 18 includes a relatively flat outer surface 20 having any one of a number of different designs for adherence of the projectile 10. For example, it is contemplated that a dart-type scoreboard can be provided on the outer surface 20 wherein points are scored by adhering the projectile within certain areas on the outer surface 20 of plate number 18. Plate number 18 also includes an inner surface 22 having a plurality of ribs 24 extending downward from the inner surface 22 in a spaced apart relation. These ribs 24 are intended to provide the plate member 18 with structural support. The plate member 18 further includes a projecting lip 26 located along the periphery of the inner surface 22. The top of the lip 26 is provided with an inwardly projecting flange 28 which provides an abutting surface to secure the plate member 18 to the backing member 30.

Figure 2:
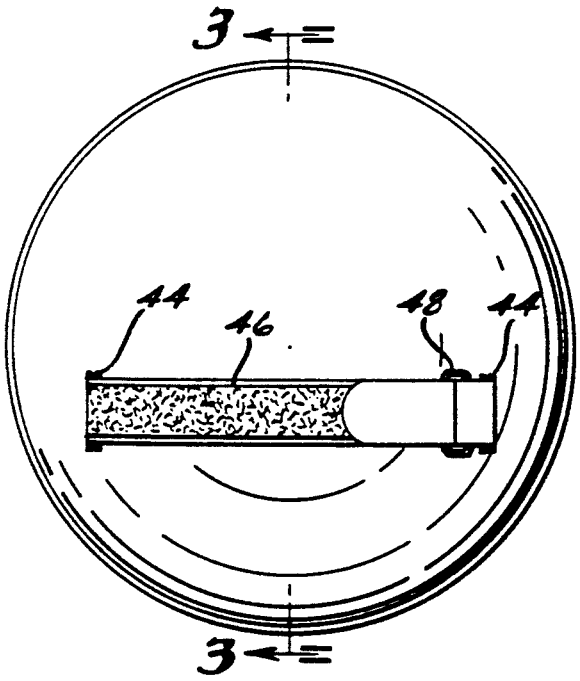
FIG. 2 is a rear view of the present invention showing the selectively moveable and adjustable strap.

Prior to combining the plate member 18 and backing member 30 to form target structure 16, the strap 46 is drawn through the slots 44 to allow an individual to control the position of the target structure. As shown more clearly in FIG. 2, the strap 46 has a buckle 48 contained on a first end through which the second end of the strap is looped. When the strap 46 has been drawn through the slots 44 and looped through buckle 48, the second end is folded back over the body of the strap. The second end of the strap is provided with Velcro® hooks and the body of the strap is provided with Velcro® padding which allows the strap to be adjusted and locked in the desired position.

Once the strap 46 has been looped through backing member 30, the plate member 18 and the backing member 30 can be combined to form the target structure 16. The inwardly projecting flange 28 of plate member 18 is snapped over the outwardly projecting annular surface 42 of the backing member 30 until the annular surface is fully contained underneath flange 28. As the flange 28 is initially being snapped over annular surface 42, the outermost rib **24*a*, which extends from the inner surface 22 of plate member 18 helps to preclude misalignment of the plate member 18**.

Importantly, the design of the present invention provides for an air gap 50 between the inner surface 34 of the backing member 30 and the inner surface 22 of the plate member 18 when the plate member 18 is locked over the backing member 30. This air gap 50 allows the outer surface of the plate member to flex inwardly slightly as it is contacted by the projectile 10. This flexing increases the likelihood that the projectile will adhere to the outer surface of the plate member 18.

As noted, it will be understood that the outer surface 20 of the plate member 18 can be provided with a plurality of different adhering surfaces at which any one of a number of different types of projectiles can be directed within the scope of the present invention. In the preferred embodiment, the surface has a smooth, glossy finish which is a result of the molding process or can be provided by a laminate coating, such as a thin paper film, applied after the plate member has been molded. The projectile 10 for adherence to the outer surface 20 of plate member 18 preferably has a shuttle cock like body 12 incorporating a suction cup 14 on its leading end. The neck of the shuttle cock is elongated and enables the person throwing the shuttle cock to grip it with all four fingers and the thumb. This allows the person throwing the shuttle cock to project it in a more accurate direction.

Those skilled in the art will now come to appreciate some of the advantages of the present invention. The target structure of the present invention allows for greater adherence by the suction cup of the projectile to the outer surface of the plate member. The target structure is also adaptable to provide for a number of different games. The plate member can be detached from the backing member to disclose the inner surface of the backing member which is optionally provided with an additional adhering surface for throwing game. The skilled practitioner will realize still other advantages of the invention after having the benefit of studying the specification, drawings and the following claims.

What is claimed:

1. An aerial throwing game, comprising:

a projectile having means for adhering to a surface; and a two-piece, hand-held, target structure including a plate member, a backing member, and locking means for detachably connecting said members together, a cavity provided between the plate member and the backing member, said plate member having an outer surface for temporarily receiving and adhering said projectile and an inner surface facing said cavity, a user's backing member including an outer surface for receiving said hand and an inner surface facing said cavity, and said locking means comprises first and second annular lips extending, respectively, transversely from the outer periphery of said plate member and said backing member for interfitting and interlocking engagement with one another, the first lip extending in the direction of said backing member and including an annular flange, and the second annular lip extending in the direction of said plate member and including an annular surface, said flange to snap over and interlock with said surface.

2. The aerial throwing game as claimed in claim 1 wherein a plurality of ribs project from the inner surface of said plate member whereby to make said plate member semi-rigid.

3. The aerial throwing game as claimed in claim 2 wherein the outer periphery of each said member and said ribs are generally circular, and formed on concentric circles each having its center generally at the center of said plate.

4. The aerial throwing game of claim 1 wherein the outer surface of said plate member is provided with a smooth finish.

5. The aerial throwing game of claim 4, wherein said backing member has a concave shape.

6. The aerial throwing game of claim 4, further including plate stiffening means extending from the inner surface of said plate member for providing the plate member with structural support.

7. The aerial throwing game of claim 1, wherein said backing member further comprises attachment means for attachment of a handle means.

8. The aerial throwing game of claim 7, wherein said attachment means includes a plurality of slots, and said handle means includes a strap having second locking means, said strap being looped through said plurality of slots to thereby provide means for controlling the position of said backing member relative to the hand.

9. The aerial throwing game of claim 8, wherein said second locking means comprises Velcro® hooks and padding.

10. The aerial throwing game of claim 8, wherein said plate member has an overall circular shape.

11. The aerial throwing game of claim 1, wherein said cavity allows the plate member to flex as said plate member is contacted by said projectile, whereby said flexing facilitates the adherence of said projectile.

12. The aerial throwing game of claim 1, wherein the inner surface of said backing member is provided with a secondary target surface, whereby said inner surface is capable of receiving said at least one projectile upon detachment of said plate member.

13. The aerial throwing game of claim 12, wherein said target surface is a Velcro® pad.

14. The aerial throwing game of claim 1, wherein said plate member and said backing member are comprised of plastic.

15. The aerial throwing game of claim 1, wherein the means for adhering to a surface comprises a suction cup attached at a first end of said projectile.

16. The aerial throwing game of claim 15, wherein said projectile comprises a shuttle cock.

17. The aerial throwing game of claim 1, wherein said means for adhering to a surface further comprises Velcro®.

* * * * *